US005958170A

United States Patent [19]

Cetrangolo

[11] Patent Number: 5,958,170

[45] **Date of Patent: *Sep. 28, 1999**

[54] METHOD FOR ENGRAVING ARTICLES

[75] Inventor: David Cetrangolo, Land O'Lakes, Fla.

[73] Assignee: Design Services, Inc., Land O'Lakes, Fla.

[ * ] Notice: This patent issued on a continued prosecution application filed under 37 CFR 1.53(d), and is subject to the twenty year patent term provisions of 35 U.S.C. 154(a)(2).

[21] Appl. No.: 08/767,087

[22] Filed: Dec. 13, 1996

[51] Int. Cl.[6] ..... B24C 1/04; B05D 3/10

[52] U.S. Cl. ..... 156/247; 156/308.6; 156/328; 156/329; 156/330.9; 156/331.6; 156/332; 156/333; 156/334; 156/344; 451/31; 451/38; 451/41

[58] Field of Search ..... 451/29, 38, 31, 451/41; 156/308.6, 328, 329, 330.9, 331.6, 332, 333, 334, 344, 247

[56] References Cited

U.S. PATENT DOCUMENTS

| | | | |
|---|---|---|---|
| 1,954,672 | 4/1934 | Kavanaugh | 451/29 |
| 3,212,957 | 10/1965 | Linda et al. . | |
| 3,442,731 | 5/1969 | Anderson . | |
| 3,586,598 | 6/1971 | Beemer . | |
| 4,035,546 | 7/1977 | Ruppert, Jr. . | |
| 4,355,074 | 10/1982 | Stemmler et al. . | |
| 4,430,416 | 2/1984 | Goto et al. . | |
| 4,612,737 | 9/1986 | Adee et al. . | |
| 5,151,572 | 9/1992 | Jack | 219/121.69 |
| 5,232,536 | 8/1993 | Oshiro et al. . | |
| 5,320,693 | 6/1994 | Helf . | |

OTHER PUBLICATIONS

3M "Buttercut" Sandblast Stencil 507, Nov. 1994.
3M Die–Cut Sandblast Stencil 509, Jun. 1995.

*Primary Examiner*—Jan H. Silbaugh
*Assistant Examiner*—Kenneth M. Jones
*Attorney, Agent, or Firm*—Joseph C. Mason, Jr.; Dennis G. LaPointe

[57] ABSTRACT

The present invention relates to a method of engraving objects which circumvents the necessity of mechanically scrubbing the engraved surface to remove fillers. Specifically, in the method of the present invention, the fillers are applied directly to the resist stencil instead of being applied to the object to be engraved. Removal of the resist stencil simultaneously removes the filler from the engraved object.

19 Claims, No Drawings

METHOD FOR ENGRAVING ARTICLES

FIELD OF THE INVENTION

This invention relates, generally, to the use of adhesives in resist stencil engraving methods. Specifically, the present invention relates to the use of removable adhesives in-resist stencil engraving methods.

BACKGROUND OF THE INVENTION

Millions of objects, made of various materials, including, wood, stone, glass, metal, cement and brick are engraved each year. Perforation and Engraving perforation methods are disclosed in U.S. Pat. No. 4,612,737 to Adee et al. and U.S. Pat. No. 4,430,416 to Goto et al. Mechanical engraving processes typically involve the use of drilling, cutting, laser burning or sandblast engraving procedures. The majority of mechanical engraving is done with the use of resist stencils, fillers and sandblast engraving processes. Numerous abrasive materials can be used in sandblast engraving processes, including, steel shot, silicon carbide, and aluminum oxide. Typically, a sheet material capable of becoming a resist stencil is adhesively affixed to the surface of an article to be engraved. During the engraving process, the stencil covers part of the surface being engraved and protects the covered surfaces from the abrasives used for frosting the object's surface and engraving lettering and designs into the object's surface. Frosting removes the polish from the object's surface which imparts contrast and texture to the surface. Frosting is also referred to as dusting or steeling.

Flat carved designs are designs which are created to an even depth by engraving flat lines to create all images of the design. Shape carving or engraving is used to create, for example, leaves, flowers and other designs that are shaped or sculpted to resemble lifelike images. Fine shaping nozzles are used to sculpt these images to varied depths and realistic shapes. Those skilled in the art know that the formation of sculpted or shaped areas can be accomplished prior to sinking the lines to be sunk of the engraved object. Sculpting or shaping imparts a three dimensional appearance to the engraved object because the sculpting or shaping is done below the plane of the surface of the engraved object.

Generally a resist stencil itself is adhesively backed. Depending on the texture of the surface being engraved, a filler, which is brushed, sprayed or otherwise applied directly to the surface of the object to be engraved, may be required to ensure uniform adhesion of the resist stencil during the engraving process. Prior to application of the filler, the object's surface must be clean and dry, i.e., free of particulates, fine dust and moisture. Further, in some engraving processes, a filler which has an adhesive component may be necessary for proper adhesion of the resist stencil to porous, rough, or frosted surfaces. In the absence of these fillers, the resist stencil may be lifted away from the object's surface during the engraving process. Stencil lifting can result in damage to polished or frosted surfaces and destroy or create an inferior quality of the lettering and designs on the engraved object. The use of additional fillers, including adhesive fillers, during the engraving process avoids these problems.

Currently, after the engraving process, virtually every engraved object must be mechanically scrubbed to remove these fillers. Until recently, all fillers were removed from engraved surfaces by mechanical scrubbing in conjunction with the use of caustic solvent cleaners, such as, citrus cleaner or naphtha. After scrubbing with the caustic solvent cleaners, each engraved object must then be washed with soap and water to remove any remaining cleaning solvent residue. Inadequate removal of either the fillers or the caustic solvent cleaners results in staining and discoloration of the surface of the engraved object.

Recently, water soluble fillers have been developed which circumvent the necessity of using caustic solvent cleaners during the mechanical scrubbing process. However, these fillers must still be removed from the engraved surface with mechanical scrubbing and washing with water.

Alternative engraving processes have attempted to avoid the necessity of mechanically scrubbing the engraved surface to remove the fillers. However, these alternatives have been met with limited success. For example, it has been found that engraving processes which use 3M Scotch® Brand adhesive transfer tape, product number 465, as an adhesive filler, in conjunction with a resist stencil, alleviate the necessity of mechanically scrubbing the engraved surface after engraving processes performed on square or rectangular objects. Specifically, the 3M Scotch® Brand adhesive transfer tape adhesive filler is applied to the back of the stencil. Any overlapping edges of the adhesive transfer tape are then trimmed from the stencil edges. Trimming is necessary to avoid the formation of an adhesive web structure that is virtually impossible to remove. Oftentimes the adhesive web is formed during the trimming process itself. After trimming, the stencil is then applied to the surface of the square or rectangular object to be engraved. After the stencil is positioned properly and rolled or pounded into place, the square or rectangular article is carved, etched or engraved. Following engraving, the stencil is removed from the engraved surface which simultaneously removes the adhesive filler. The usefulness of this particular adhesive filler is very limited because it cannot be removed from randomly shaped objects or randomly shaped designs without the formation of an adhesive web structure that is impossible to remove from the engraved object. Specifically, this adhesive filler can only be used in conjunction with the engraving done on square or rectangular surfaces that do not include complex or randomly shaped designs.

Another engraving approach which eliminates the necessity of mechanically scrubbing the engraved surface uses a resist stencil and a non-adhesive filler. Specifically, the non-adhesive filler is applied to the object to be engraved, followed by application of the resist stencil over the filler. After the stencil is positioned properly and rolled or pounded into place the article is carved, etched or engraved. After the object is engraved the stencil is removed, wadded into a ball and aggressively rubbed over the engraved surface to remove the filler. During the aggressive rubbing process the filler sticks or tacks to the stencil surface and is removed from the engraved surface. However, this approach is only useful in engraving processes involving small surface areas, such as, for example, engraving name plates.

Since it is virtually impossible, in most engraving processes, to avoid the use of additional fillers, the removal of the filler by mechanical means from an engraved surface continues to be problematic.

In view of the prior art considered as a whole at the time the present invention was made, it was not obvious to those of ordinary skill in the pertinent art how these problems could be overcome.

SUMMARY OF THE INVENTION

The long-standing but heretofore unfulfilled need for improvements in engraving methods is now met by an improved engraving method, comprising applying an adhesive material to a surface of a resist stencil, applying the adhesively coated surface of the resist stencil to a porous, rough or frosted surface of a randomly shaped object to be engraved, engraving the object, removing the adhesively coated resist stencil from the engraved object wherein the adhesive material is removed from the engraved object with the resist stencil. Adhesives useful in the present invention have a peel stress of from 2.5 to 5.5 pounds per square inch and bond to the surface to which they are first applied.

The invention accordingly comprises the features that will be exemplified in the description hereafter set forth, and the scope of the invention will be indicated in the claims.

DETAILED DESCRIPTION OF THE INVENTION

The improved method of the present invention for mechanically engraving objects is useful in double and single process engraving methods which use either double or single backed resist stencils. For purposes of the present invention a filler is any substance used by the skilled artisan during an engraving process to compensate for differences in, or areas of unevenness or porousness, found on the objects surface. These fillers may or may not have an adhesive component. The present invention is useful in engraving processes including drilling, cutting, laser burning and sandblast engraving procedures. A single process engraving method is one in which the sink lines are engraved first and frosting is done last. A double process engraving method is one in which frosting is done first and the sink lines are sunk after the frosting is complete. Double process engraving methods require that the frosted areas are uncovered for the frosting process and then recovered after frosting for the remainder of the engraving process. Double process methods are more time consuming than single process engraving methods but they create a better quality engraving, resulting in cleaner edges without rounding of the sink lines. For some applications cleaner edges in which the sink lines are not rounded will be required. However, if clean edges are not required a single process engraving method can be performed.

A double backed resist stencil has two liners adhered to a thin layer of rubber. One of the liners, the outside liner, is discarded when the resist stencil is adhered to a porous, rough or frosted surface of a randomly shaped object to be engraved. A single backed stencil has only one liner, an outside liner. This outside liner is removed when the stencil is adhered to the object to be engraved. If lettering has been cut into the single backed stencil it is impossible to move or reposition the stencil once the liner has been removed to expose the adhesive. In order to avoid this problem, masking or any other appropriate tape material is applied to the top, non-adhesive surface of the stencil so that when the stencil is moved or repositioned the centers of letters and other carving details of the stencil do not fall apart.

Generally, the use of single and double backed stencils require the use of adhesive fillers. In particular, when single or double backed stencils are used for engraving frosted surfaces, adhesive fillers are required. Oftentimes the entire surface of the object to be engraved is initially frosted or steeled which necessitates the use of an adhesive filler when a single or double backed stencil is used for the engraving process. However, manufacturers produce resist stencils that normally have a high enough adhesion to properly adhere to polished surfaces. This is particularly true when blasting pressures are low and/or frosting angles are not sharp. Widely varying factors, including but not limited to, blasting pressures, abrasives, blasting nozzles, adhesive aggressions, frosting angles, and surfaces cause engravers, skilled in the art, to apply additional filler adhesives. Not only does this increase adhesion, but it further guarantees an engravers sense of security when the objects being engraved are valuable.

Specifically, the method of the present invention is useful in a single process engraving method which engraves a steeled, frosted or porous surface using a single backed or double backed resist stencil. In this process, according to the present invention, after removal of the stencil's outside liner an adhesive filler is applied directly to the resist stencil. When a single backed stencil is used, the top, non-adhesive surface may be taped or otherwise secured to avoid the disorientation of stencil pieces during placement and re-positioning of the stencil. When double backed stencil is used, the inner stencil liner eliminates taping the top, non-adhesive surface of the stencil and is abraded away from the object's surface during the engraving process. It is understood by those skilled in the art that the resist stencil itself may be adhesively coated prior to application of an additional adhesive filler. After the application of the adhesive filler to the stencil's surface, the resist stencil is applied to the surface of an object to be engraved. The sink lines are then removed from the resist stencil and are sunk or engraved with a blown abrasive.

The present invention is also useful in a double process engraving method which engraves a polished surface using single backed or double backed resist stencils. In this double process engraving method, after removal of the stencil's outside liner an adhesive filler is applied, according to the present invention, directly to the stencil. After the application of the adhesive filler to the stencil's surface, the resist stencil is applied to the surface of an object to be engraved.

Panels of the resist stencil are removed exposing polished surfaces that are to be frosted, steeled, dusted, or axed to impart a textured appearance, by blowing an abrasive material over the surface of the object. This process removes the polish from desired areas of the surface to be engraved which gives a textured and contrasted surface to the engraved object. After frosting, an adhesive filler is applied, according to the present invention, directly to the removed resist stencil panels and the stencil panels are put back into place. The inner liner on double backed stencil eliminates taping, stretching, and distortion during the removal and replacement process of the panels. Single backed stencil may require taping the top, non-adhesive surface to avoid loss of stencil pieces during placement and repositioning of the stencil. Following replacement of the panels, the sink lines are removed from the resist stencil. The object is then further engraved by sinking the lines to be sunk with a blown abrasive.

In addition, the method of the present invention is useful in a single process engraving method which engraves a polished surface using single backed or double backed resist stencils. In this single process, after removal of the outside liner of the resist stencil, an adhesive filler is applied, according to the present invention, directly to the stencil. It is understood by those skilled in the art that, when using double back stencil, the inner liner of the resist stencil is abraded away from the object's surface during the engraving process. Further, when using single backed stencil, that the top, non-adhesive surface of the stencil may be taped or secured to facilitate handling during the engraving process. The filler-coated stencil is applied to the surface of the object to be engraved. The sink lines are then removed from the resist stencil and are sunk or engraved. After sinking the lines to be sunk, the portions of the object that are to be frosted are then exposed by removal of the appropriate stencil and, if desired, liner pieces, followed by blowing an abrasive across the object's surface which imparts a frosted appearance to the exposed portions.

Those skilled in the art know that the formation of sculpted or shaped areas can also be done with both types of stencils and both types of engraving processes and is accomplished prior to sinking the sink lines. For example, in the formation of engraved leaves, the resist stencil leaves are removed from the stencil exposing the surface to be shaped or sculpted. The leaves are engraved below the surface of the plane of the object. Specifically, in a process using a double backed stencil, the plastic backing is abraded off the object after removal of the leaves and the leaves are then engraved below the surface of the plane of the object. Following the shaping process the floral leaves of the stencil are coated with an adhesive filler, according to the present invention. The floral leaves of the stencil are then replaced onto the shaped objects and the sink lines of the entire design are removed and engraved. Sculpting or shaping requires the use of adhesive fillers regardless of the engraving process or type of stencil used.

According to the present invention, after an engraving process is completed, the stencil is removed from the engraved object by pulling the stencil away from the engraved surface with an even movement. The adhesive filler is simultaneously removed from the engraved surface with the resist stencil. If any residual filler remains on the engraved surface after removal of the resist stencil, the remaining filler is easily removed by gently blotting a piece of the removed stencil on the filler residue. The residual filler sticks or tacks to the stencil surface and is easily removed from the engraved surface. In the present invention, the application of the filler directly to the resist stencil circumvents the need for any mechanical scrubbing of the engraved surface to remove fillers after the engraving process.

Resist stencil substrates which can be employed in the present invention may be made of any flexible material. For example, flexible substrates such as plastic films, aluminum foils, paper and rubber sheets including polyethylene, polyethylene terephthalate, polyvinyl chloride, cellulose acetate and cellophane are useful in the present invention. Resist stencil materials, such as photosensitive sheets are also useful. The thickness of resist stencils useful in the present invention ranges from about 1 mil to about 65 mil, preferably from 2 mil to 55 mil, while in a most preferred embodiment from 20 mil to 49 mil. The sheet-like resist stencil materials useful in the present invention preferably include polyvinyl chloride and rubber sheets. For example, any of the resist stencils available from 3M (St. Paul, Minn.), Hartco (Cincinnati, Ohio) and Anchor Continental (Columbia, S.C.) are useful in the present invention. The entire surface of the stencil at its resist side may be provided with a strippable protective film which facilitates storage and transport. Strippable protective films such as silicone-coated paper and other release papers are known in the art.

In the present invention, prior to applying a resist stencil to an object to be engraved the surface of the stencil is treated or coated with an adhesive filler. The adhesive filler may be applied to or coated on the resist stencil by methods known in the art. For example, the stencil may be coated with the adhesive filler by spraying, painting, or other application methods known in the art.

Diverse adhesives which include natural, semi-synthetic or synthetic polymers are useful in the present invention. Suitable polymers include alkylcelluloses, such as methylcellulose and ethylcellulose; hydroxyalkylcelluloses, such as hydroxyethylcellulose; mixed ethers of hydroxyethylcellulose, such as methylhydroxyethylcellulose, methyl-hydroxypropylcellulose, or ethylhydroxyethylcellulose; starch ethers; vegetable gums which are substituted by non-ionic groups, such as carob bean flour; polyvinyl alcohol; polyvinyl ethers; polyvinyl esters, such as polyvinyl acetate, polyvinylpyrolidone; polyurethanes and mixtures of these compounds. The adhesives of the present invention may contain additional suitable polymers including, for example, carboxymethylcellulose; carboxyethhylcellulose; sulfoethylcellulose; oxidized celluloses; alginates; alginic acid esters; carboxymethyl starch; oxidized starches; starch phosphates; vegetable gums which are substituted by ionic groups; polyacrylamide; polyacrylates; acrylic resins; polyvinyl acetate copolymer; natural rubber; rubber hydrochloride; butadiene rubber; chloroprene rubber; silicone rubber and mixtures of these compounds. Additional adhesives useful in the present invention are disclosed in U.S. Pat. Nos. 4,845,149; 4,879,333; and 4,923,919; all to Frazee, which are incorporated herein by reference.

Adhesives useful in the present invention are evaluated in a laboratory peel test and a laboratory tack test. In the peel test, a 1"×6" strip of resist stencil is brushed or spray coated with a layer of test adhesive. When the adhesive layer is slightly tacky to the touch, the resist stencil strip is applied to the object to be engraved and rolled or pounded into place. The test panels are allowed to stand under no pressure for 1 minute up to 48 hours. The test strip is then peeled back at 180° at a rate of 2" per minute and the force required to peel is registered as pounds per inch of strip width. Adhesives useful in the present invention preferably have a peel stress of from 2.5 to 5.5 pounds per square inch.

The tack test may be performed on a laboratory-constructed tackmeter. Briefly, the term "tack" relates to the rate at which an adhesive bond forms between two surfaces. For example, the tackmeter may be a simple triple beam balance suspended 10 inches above a scissors jack, having a cylindrical metal rod, eight inches long, with one end ground to a pencil-like one-sixteenth inch diameter point, which is suspended from a balance pan. Test adhesives are prepared by putting a known volume of test adhesive into open cup molds and oven drying the adhesive at 100° C. Each test adhesive is placed in contact at its center point with the contact rod of the tackmeter by raising the filler in its mold up to the contact rod on the jack. Contact is maintained with no increase in pressure for a standard length of time, approximately 60 seconds. The polymers from which the adhesives are made for the test must have percent total solids in the same general range, plus or minus 5%. After a contact time of one minute, onehalf gram weights are added to the balance at uniform time intervals, usually 5 seconds, until sufficient weight causes the contact rod to break loose from the tacky, dried polymer adhesive. This weight has to overcome only the adhesive's tack which, after subtracting the tare weight of the contact rod, is a direct measurement of tack and is easily converted to grams per square centimeter of force. Each adhesive is prepared and tested in the same manner.

The desired "tack" physical properties of the adhesives useful in the present invention may range from 50 to 2000 grams per square centimeter, and preferably range from 100 to 1500 grams per square centimeter, while in a most preferred embodiment range from 150 to 1000 grams per square centimeter. Methods for determining "tack" values of various adhesives suitable for use in the present invention, are as disclosed and discussed in U.S. Pat. No. 4,879,333 to Frazee, which is incorporated herein by reference.

The physical properties of a particular adhesive are specifically selected such that the adhesive bonds to the resist stencil rather than to the object being engraved and, further, such that the adhesive is readily removed from the object when the stencil is removed. Specifically, the physical properties of a particular adhesive are specifically selected such that the adhesive filler bonds preferentially to the surface to which it is first applied. While not wishing to be bound by any one theory, it is believed that the coefficient of adhesion formed between the resist stencil and the adhesive is greater than the coefficient of adhesion formed between the adhesive and the object to be engraved. For example, suitable adhesives for purposes of the present invention may be obtained from 3M (St. Paul, Minn.) and Anchor Continental (Columbia, S.C.).

The adhesive should be applied to the resist stencil in a thickness sufficient to insure adhesion, but should not be applied too thickly such that it is not easily removed from the engraved surface with removal of the resist stencil. Typically, the adhesive is applied to the resist stencil in a thickness which is sufficient to compensate for irregularities in the surface of the object to be engraved and to ensure that stencil lifting is prevented during the engraving process. In general, depending upon the adhesive used, one or more applications of adhesive to the resist stencil may be necessary to achieve these results. Further, for many adhesives useful in the present invention, a layer of from 0.025 mil to 20 mil in thickness will be sufficient to achieve these results.

After application of the adhesive to the resist stencil, the stencil is sufficiently pressed and adhered onto the surface of an article to be engraved. Numerous engraving nozzles can be used in the present invention, including, but not limited to straight bore nozzles, venturi bore nozzles, and rosette shape carvers. It is also understood that these nozzles may be tapered, threaded or flanged. Nozzle diameters can range from 1/64 of an inch to an inch. Other nozzle diameters may be selected depending on the individual choices of the skilled artisan. For example, engraving nozzles available from Norton Advanced Ceramics (Worcester, Mass.) are useful in the present invention.

The adhesives of the present invention are useful in engraving process which are carried out at engraving pressures of from 3 to 180 pounds per square inch, in a preferred embodiment the engraving pressures are from 60 to 160 pounds per square inch, while in a most preferred embodiment the engraving pressures are from 80 to 120 pounds per square inch. Numerous abrasive materials can be used in the engraving processes of the present invention, including, but not limited to steel shot, silicon carbide, and aluminum oxide.

EXAMPLES

The following examples are presented to illustrate the invention, which is not intended to be in any way limited thereto, since numerous modifications and variations therein will be apparent to one skilled in the art. Actual experimental data was obtained as follows:

Example 1

Gray granite samples were obtained from Elberton, Ga. The samples were frosted to impart a contrasted texture to their surface. 3M brand, number 519, sandblast stencil was used for the engraving process. After removal of the outside liner of the stencil, 3M Scotch brand No. 2 sandblast adhesive filler was applied directly to the stencil. The No. 2 adhesive filler was painted onto the stencil without any dilution. One application of No. 2 adhesive filler was applied to the stencil. The coated stencil was allowed to dry until the filler lost its wet look and the adhesive was just slightly tacky to the touch. The drying time was about 15 minutes. After the filler was sufficiently dry the stencil was applied to the granite sample, and rolled or pounded into place. Test panels of the granite sample were then engraved at blasting pressures of 80, 100 and 120 pounds per square inch. A Norton straight bore engraving nozzle having a ¼ inch diameter orifice available from Norton Advanced Ceramics (Worcester, Mass.), and Dupont 60 Grit Starblast available from Dupont (Wilmington, Del.), were used for the engraving process.

Following the engraving process, the resist stencil was removed from the engraved sample by evenly pulling the stencil away from the engraved surface. The adhesive filler was removed from the engraved surface with the resist stencil. The filler was removed cleanly from the engraved surface without any mechanical scrubbing. Further, no stencil lifting occurred during the engraving process.

Example 2

Gray granite samples were obtained from Elberton, Ga. The samples were frosted to impart a contrasted texture to their surface. 3M brand, number 519, sandblast stencil was used for the engraving process. After removal of the outside liner of the stencil, 3M Scotch brand No. 2 sandblast filler was applied directly to the stencil. The No. 2 filler was sprayed onto the stencil after diluting with Coleman fuel available from Coleman Company (Wichita, Kans.). Specifically, 50 mls of Coleman fuel was added to 500 mls of No. 2 filler. The diluted adhesive filler was then sprayed on the resist stencil to provide an even coat on the stencil. A standard industrial paint sprayer was used for this purpose. In the present example a compressor pressure of 80 pounds per square inch coupled with a gun pressure of 30 pounds per square inch was sufficient to achieve even coverage. Two applications of the diluted No. 2 filler was sprayed onto two center panels of the stencil. The two center panels were engraved at 80 and 100 pounds per square inch pressure, respectively. The two outside panels of the stencil were sprayed with one coat of adhesive filler and were subsequently engraved at 80 and 120 pounds per square inch pressure, respectively. The coated stencil was allowed to dry between applications until the filler lost its wet look and the adhesive was just slightly tacky to the touch. The drying time for the first application was about 15 minutes while the drying time for the second application was about 45 minutes. After the filler was sufficiently dry the stencil was applied to the granite sample and rolled or pounded into place. Test panels of the granite sample were then engraved at blasting pressures of 80, 100 and 120 pounds per square inch, as described above. A Norton straight bore engraving nozzle having a ¼ inch diameter orifice available from Norton Advanced Ceramics (Worcester, Mass.), and Dupont 60 Grit Starblast available from Dupont (Wilmington, Del.), were used for the engraving process.

Following the engraving process, the resist stencil was removed from the engraved sample by evenly pulling the stencil away from the engraved sample. The adhesive filler was removed from the engraved surface with the resist stencil. The filler was removed cleanly from the engraved surface without any mechanical scrubbing. Further, no stencil lifting occurred during the engraving process. No differences were found between the test panels treated with one application of adhesive filler and those treated with two applications.

This invention is clearly new and useful. Moreover, it was not obvious to those of ordinary skill in this art at the time it was made.

The advantages of the present invention will thus be seen, and those made apparent from the foregoing description, are efficiently attained. Since certain changes may be made in the foregoing description without departing from the scope of the invention, it is intended that all matters contained in the foregoing description shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

Now that the invention has been described,

What is claimed is:

1. A method of engraving a porous, rough or frosted surface of a randomly shaped object by sandblast engraving without the use of a filler material comprising the steps of:

(a) providing a resist stencil material having at least one surface with an adhesive material;

(b) applying an additional coat of an adhesive material to said surface of the resist stencil under conditions sufficient to permit the adhesive to become tacky;

(c) applying the tacky adhesively coated surface of the resist stencil to a surface of the object to be engraved, wherein the resist stencil with its tacky adhesively coated surface is capable of being subjected to engraving forces caused by sandblasting without dislodging from the surface of the object to be engraved;

(d) engraving the surface of the object; and (e) removing the adhesively coated resist stencil from the porous, rough or frosted surface of the engraved randomly shaped object, whereby the adhesive material is simultaneously removed from the engraved randomly shaped object with the resist stencil thereby circumventing the need for any mechanical scrubbing and washing of the engraved surface to remove residual adhesive material after the engraving.

2. The method of claim 1 wherein the adhesive material has a peel stress of from 2.5 to 5.5 pounds per square inch.

3. The method of claim 1 wherein the adhesive material is applied to the resist stencil in a layer of from 0.025 mil to 20 mil in thickness.

4. The method of claim 1 wherein the object is engraved at a pressure of from 3 to 180 pounds per square inch.

5. The method of claim 1 wherein the object is engraved at a pressure of from 60 to 160 pounds per square inch.

6. The method of claim 1 wherein the object is engraved at a pressure of from 80 to 120 pounds per square inch.

7. The method of claim 1 wherein the adhesive material include natural, semi-synthetic and synthetic polymers.

8. The method of claim 7 wherein the material, semi-synthetic and synthetic polymers are selected from alkylcelluloses; hydroxyalkylcelluloses; polyvinyl alcohol; polyvinyl ethers; polyvinyl esters; polyvinylpyrolidone; polyurethanes; carboxymethylcellulose; carboxyethhylcellulose; sulfoethylcellulose; oxidized celluloses; alginates; alginic acid esters; carboxymethyl starch; polyacrylamide; polyacrylates; acrylic resins; polyvinyl acetate copolymer; natural rubber; rubber hydrochloride; butadiene rubber; chloroprene rubber and silicone rubber.

9. The method of claim 1 wherein the adhesive material bonds the surface to which it is first applied.

10. The method of claim 1 wherein the adhesive material has a tack property of from 50 to 2000 grams per square centimeter.

11. The method of claim 1 wherein the adhesive material has a tack property of from 100 to 1500 grams per square centimeter.

12. The method of claim 1 wherein the adhesive material has a tack property of from 150 to 1000 grams per square centimeter.

13. The method of claim 1 wherein the resist stencil is from 1 mil to 65 mil thick.

14. The method of claim 1 wherein the resist stencil is from 2 mil to 55 mil thick.

15. The method of claim 1 wherein the resist stencil is from 20 mil to 49 mil thick.

16. The method of claim 1 wherein the adhesive material is applied to the resist stencil by spraying.

17. The method of claim 1 wherein the adhesive material is applied to the resist stencil by painting.

18. The method of claim 1 wherein the adhesive material is applied to the resist stencil by brushing.

19. The method of claim 1 wherein the coefficient of adhesion formed between the resist stencil and the adhesive material is greater than the coefficient of adhesion formed between the adhesive material and the randomly shaped object to be engraved.

* * * * *